US009211007B2

(12) United States Patent
Brunnmayr et al.

(10) Patent No.: US 9,211,007 B2
(45) Date of Patent: Dec. 15, 2015

(54) DRIVE DEVICE FOR A MOVABLE FURNITURE PART

(71) Applicant: Julius Blum GmbH, Hoechst (AT)

(72) Inventors: Harald Brunnmayr, Hoerbranz (AT); Hermann Haemmerle, Lustenau (AT); Michael Blum, Hoechst (AT); Kurt Haemmerle, Lustenau (AT); Alexander Simon Flogaus, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/571,819

(22) Filed: Dec. 16, 2014

(65) Prior Publication Data

US 2015/0098667 A1 Apr. 9, 2015

Related U.S. Application Data

(63) Continuation of application No. PCT/AT2013/000095, filed on Jun. 5, 2013.

(30) Foreign Application Priority Data

Jul. 10, 2012 (AT) ..... A 769/2012

(51) Int. Cl.
*A47B 88/04* (2006.01)

(52) U.S. Cl.
CPC ..... *A47B 88/04* (2013.01); *A47B 88/0481* (2013.01)

(58) Field of Classification Search
CPC ..... A47B 88/047
USPC ..... 312/319.1, 333, 334.44, 334.46
See application file for complete search history.

(56) References Cited

U.S. PATENT DOCUMENTS

| | | | | |
|---|---|---|---|---|
| 7,077,487 | B2 * | 7/2006 | Yang | 312/333 |
| 8,721,011 | B2 * | 5/2014 | Salice | A47B 88/0481 312/333 |
| 8,746,422 | B2 * | 6/2014 | Zimmer | A47B 88/047 188/265 |
| 2009/0273263 | A1 * | 11/2009 | Berger | A47B 88/0481 312/334.1 |
| 2011/0012488 | A1 | 1/2011 | Liang et al. | |

(Continued)

FOREIGN PATENT DOCUMENTS

| | | |
|---|---|---|
| AT | 507 656 | 7/2010 |
| AT | 511 964 | 4/2013 |

(Continued)

OTHER PUBLICATIONS

International Search Report (ISR) issued Dec. 17, 2013 in International (PCT) Application No. PCT/AT2013/000095.

(Continued)

*Primary Examiner* — Matthew Ing
(74) *Attorney, Agent, or Firm* — Wenderoth, Lind & Ponack, L.L.P.

(57) ABSTRACT

A drive device for a movable furniture part, with a housing, an ejecting slide which is mounted movably in or on the housing and is intended for ejecting the movable furniture part from a closed position in the opening direction, a draw-in slide which is movable relative to the housing and is intended for drawing the movable furniture part from an open position into the closed position, and a latching element which is mounted movably on the ejecting slide and via which the ejecting slide is locked to the housing at least in the closed position, wherein the draw-in slide is coupleable to the ejecting slide via the latching element.

8 Claims, 19 Drawing Sheets

(56) References Cited

U.S. PATENT DOCUMENTS

| | | | | |
|---|---|---|---|---|
| 2013/0334946 | A1 | 12/2013 | Netzer et al. | |
| 2014/0021841 | A1* | 1/2014 | Brunnmayr | A47B 88/16 312/319.1 |
| 2014/0210329 | A1* | 7/2014 | Brunnmayr | A47B 88/0477 312/333 |
| 2014/0300262 | A1 | 10/2014 | Flogaus | |

FOREIGN PATENT DOCUMENTS

| | | |
|---|---|---|
| DE | 198 23 305 | 12/1999 |
| DE | 199 35 120 | 2/2001 |
| DE | 10 2008 004 545 | 7/2009 |
| DE | 20 2009 005 009 | 3/2010 |
| DE | 20 2010 013 193 | 3/2012 |
| DE | 20 2012 000 684 | 3/2012 |
| EP | 2 174 572 | 4/2012 |

OTHER PUBLICATIONS

Austrian Patent Office Search Report (ASR) issued Mar. 22, 2013 in Austrian Patent Application No. A 769/2012.

* cited by examiner

DRIVE DEVICE FOR A MOVABLE FURNITURE PART

The invention concerns a drive device for a movable furniture part, comprising a housing, an ejection slide mounted movably in or on the housing for ejection of the movable furniture part from a closed position in the opening direction, a retraction slide movable relative to the housing for retraction of the movable furniture part from an open position into the closed position, and a latching element which is mounted movably on the ejection slide and by way of which the ejection slide is locked to the housing at least in the closed position. The invention also concerns an article of furniture comprising such a lockable ejection device.

Lockable ejection devices have already been known for many years in the furniture fitting industry, wherein unlocking of the ejection device is effected by movement (pressing or pulling) of the movable furniture part out of the closed position and thus the movable furniture part is automatically ejected or opened.

Retraction devices are also known in the furniture fitting industry, by which in particular in the last closing portion, the movable furniture part (drawer, door, flap or the like) is moved automatically into the closed position. Damping devices for damping that closing movement are also often provided.

One of the first specifications disclosing a drive device for a furniture part, in which both an ejection device and also a retraction device are integrated, is DE 198 23 305 A1. A disadvantage with that specification is that complicated and expensive, separate coupling processes are involved on the one hand for the ejection element and on the other hand for the retraction device.

In a similar fashion that also applies to Austrian patent application A 1891/2011 to the present applicant, which was published after the relevant date and constitutes a prior right. In accordance with that specification, there is shown a drive device having a retraction slide and an ejection slide. FIG. 13 of that specification shows that the retraction slide is unlocked, wherein locking of the ejection slide is separately effected at the same time at another location in a cardioid curve. Later unlocking of the ejection slide is shown in FIG. 15. Locking of the retraction slide is in turn shown in FIG. 17. A disadvantage in regard to unlocking of the retraction slide and simultaneous locking of the ejection slide is that firstly there must be two separate devices for locking and unlocking respectively, and secondly the entire drive device is of a more complicated design configuration as a result and thirdly in simultaneous locking and unlocking noise is generated in duplicate by the latching and locking procedures.

Therefore the object of the present invention is to provide a drive device which is improved over the state of the art. In particular the invention seeks to eliminate the disadvantages in the state of the art and to provide a simpler and quieter drive device for a movable furniture part.

That is achieved by a drive device having the features according to a first aspect of the invention. In accordance therewith it is provided according to the invention that the retraction slide can be coupled to the ejection slide by way of the latching element. Therefore the latching element has a dual function and serves both for locking the ejection slide to the housing and also for locking the retraction slide to the ejection slide.

In a particularly preferred embodiment of the present invention it can be provided that in a first movement portion of the retraction slide or the movable furniture part the retraction slide is coupled to the ejection slide by way of the latching element which is disposed in a first coupling position and in a second movement portion of the retraction slide or the movable furniture part on the one hand the retraction slide is uncoupled from the ejection slide and on the other hand the ejection slide is locked to the housing by way of the latching element which is disposed in a second coupling position. The first movement portion of the retraction slide corresponds to a part of the closing movement of the movable furniture part. In that closing movement or during that first movement portion, an ejection force storage means is stressed, the storage means being fixed on the one hand to the housing and on the other hand to the ejection slide and subjecting the ejection slide to a force in the opening direction. The second movement portion also corresponds to a part of the closing movement of the movable furniture part. That second movement portion preferably corresponds to the retraction movement of the movable furniture part, that is triggered by the retraction slide. In that case the retraction force storage means is unloaded, that force storage means being fixed on the one hand to the ejection slide and on the other hand to the retraction slide and subjecting the retraction slide to a force in the closing direction.

In principle the provision of a neutral idle region or another movement portion between the first movement portion and the second movement portion should not be excluded. In order however to guarantee a fluid transition which is as quiet as possible between the movement portions, it is preferably provided that the first movement portion blends directly into the second movement portion, wherein the latching element is movable out of the first coupling position between the retraction slide and the ejection slide directly into the second coupling position between the ejection slide and the housing. Thus unlocking of the retraction slide from the ejection slide is implemented at the same time by the locking movement of the latching element on the locking element of the housing.

It is in principle possible for the retraction slide to be mounted movably directly to the housing or even for the ejection slide to be mounted movably to the retraction slide. It is preferably provided however that the retraction slide is mounted movably to the ejection slide.

In a further preferred embodiment it is provided that the retraction slide can be coupled to the movable furniture part by way of an entrainment member. The drive device can be disposed on the furniture carcass and can eject or retract an entrainment member arranged on the movable furniture part. Preferably however it is provided that the entrainment member is fixed with respect to the furniture carcass and the rest of the drive device can be moved with the movable furniture part and is retracted or ejected on the entrainment member together with the movable furniture part.

To guarantee precise detection and transmission of the position of the movable furniture part to the locking element there is preferably provided a transmission device having a movable, preferably pivotable coupling element, wherein upon movement of a detection device connected to the movable furniture part from the closed position in the opening direction the transmission device can be coupled to a connecting element of the detection device by way of the coupling element. If only the movement of the movable furniture part in the opening direction is intended to have an effect on the transmission device, then preferably the coupling element should be transferable from the connecting element of the detection device upon movement of the detection device in the closing direction.

In itself locking of the latching element can be effected by way of a frictionally locking and/or positive-engagement locking action between the latching element and the locking element. It is preferably provided that disposed in the housing at least partially is a sliding track which is preferably of a cardioid curve form for the latching element which is mounted preferably pivotably to the ejection element, wherein the locking element forms at least a part of a latching recess in the sliding track.

Protection is also claimed for an article of furniture having a drive device according to the invention.

BRIEF DESCRIPTION OF THE DRAWINGS

Further details and advantages of the present invention will be described more fully hereinafter by means of the specific description with reference to the embodiments by way of example illustrated in the drawings in which.

DETAILED DESCRIPTION OF THE INVENTION

Figure 1:
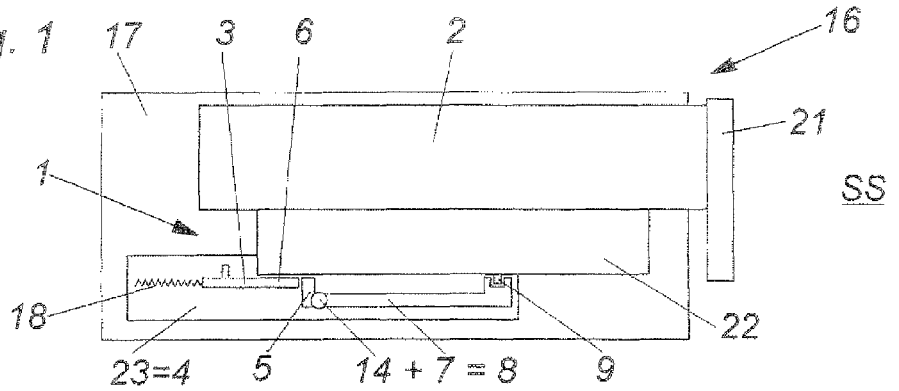
FIGS. 1 through 4 diagrammatically show a movable furniture part in various positions with a drive device.

FIG. 1 diagrammatically shows an article of furniture 16 comprising a furniture carcass 17 and a movable furniture part 2, at the front side of which is fitted a front panel 21. The movable furniture part 2 is mounted movably by way of a drawer rail 22 to a carcass rail 23—optionally also by way of a central rail (not shown). In this diagrammatic view the carcass rail 23 at the same time forms the housing 4 of the drive device 1. In FIG. 1 the entire drive device 1 is associated with the furniture carcass 17, only the entrainment member 9 moves with the movable furniture part 2. In principle the arrangement can also be precisely reversed so that the drive device 1 is associated with the movable furniture part 2 while the entrainment member 9 is arranged fixed with respect to the furniture carcass. The position of the movable furniture part 2—more specifically the entrainment member 9—is detected by way of a detection device 7 and is passed to the locking element 5 by way of the transmission slide 14 which in this case is shown as a circle. The transmission slide 14 and the detection device 7 together with possible further components form the transmission device 8 for transmission of the position, detected by the detection device 7, of the movable furniture part 2 to the locking element 5. The ejection element 3 (this can also be referred to as the ejection slide 3) is mounted movably on the housing 4 and is acted upon by an ejection force storage means 18 in the opening direction OR. As the movement of the ejection element 3 in the opening direction OR is blocked by the locking element 5 the movable furniture part 2 cannot be ejected in the opening direction OR whereby the movable furniture part 2 is disposed in the closed position SS.

Figure 2:
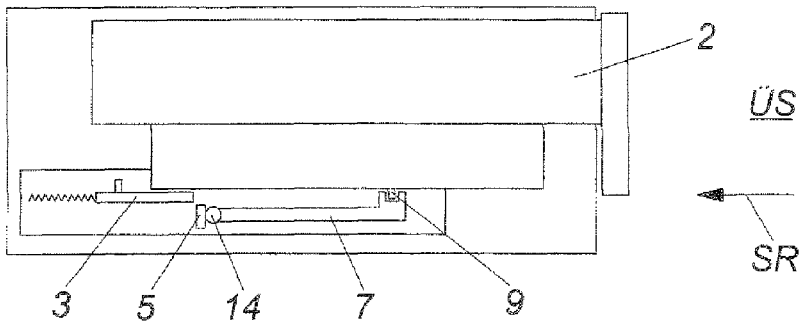

If now as shown in FIG. 2 a pressure is applied in the closing direction SR to the movable furniture part 2 then the locking element 5 is moved by way of the transmission device 8 so that the ejection path for the ejection element 3 is cleared. In the event of over-pressing in the closing direction SR the locking element 5 does not necessarily have to be moved, as shown in FIGS. 1 through 4 and FIGS. 23 through 29. Rather, the position of the movable furniture part 2 can be passed by the detection device 7 directly to the ejection element 6 arranged on the ejection element 3 so that it is moved out of a latching recess 13 in a sliding track 12 of cardioid shape into an opening portion 45 of the sliding track 12, as shown in FIGS. 5 through 22. The over-pressed position ÜS is reached by that over-pressing action.

Figure 3:
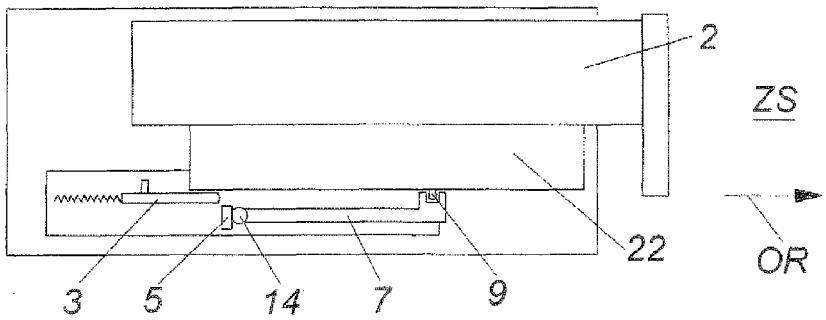

In comparison FIG. 3 shows a drive device 1 which is unlocked by pulling on the movable furniture part 2 in the opening direction OR. That opening movement is also detected by the detection device 7, whereby the locking element 5 is moved relative to the housing 4 by way of a transmission device 8 separate from the latching element 6, and thereby clears the ejection path for the ejection element 3. The pulling position ZS directly in front of the closed position SS is reached thereby.

Figure 4:
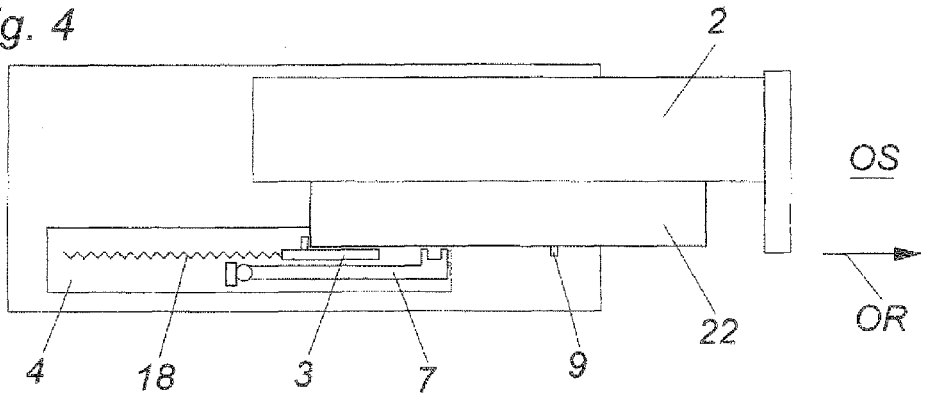

In FIG. 4 the ejection element 3, after being unlocked by pressing (as shown in FIG. 2) or by pulling (FIG. 3), due to the ejection force storage means 18 being relieved of stress, has ejected the movable furniture part 2 in the opening direction OR, whereby an open position OS is reached. Upon ejection the entrainment member 9 comes out of engagement from the detection device 7. That can be effected by the catch lever 37 of the detection device 7 being pivoted away.

Figure 5:
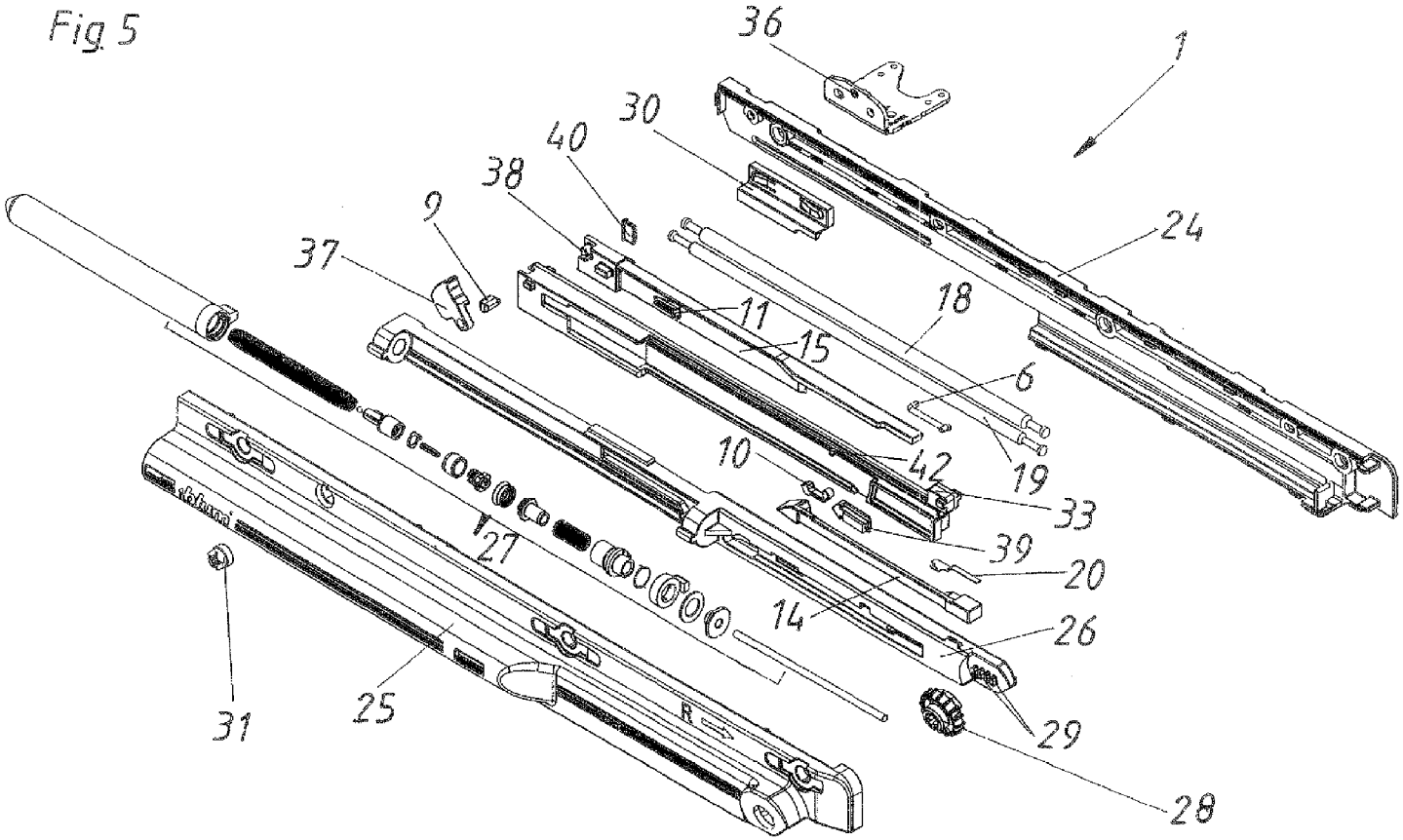
FIGS. 5 and 6 show exploded views of a drive device.
Figure 6:
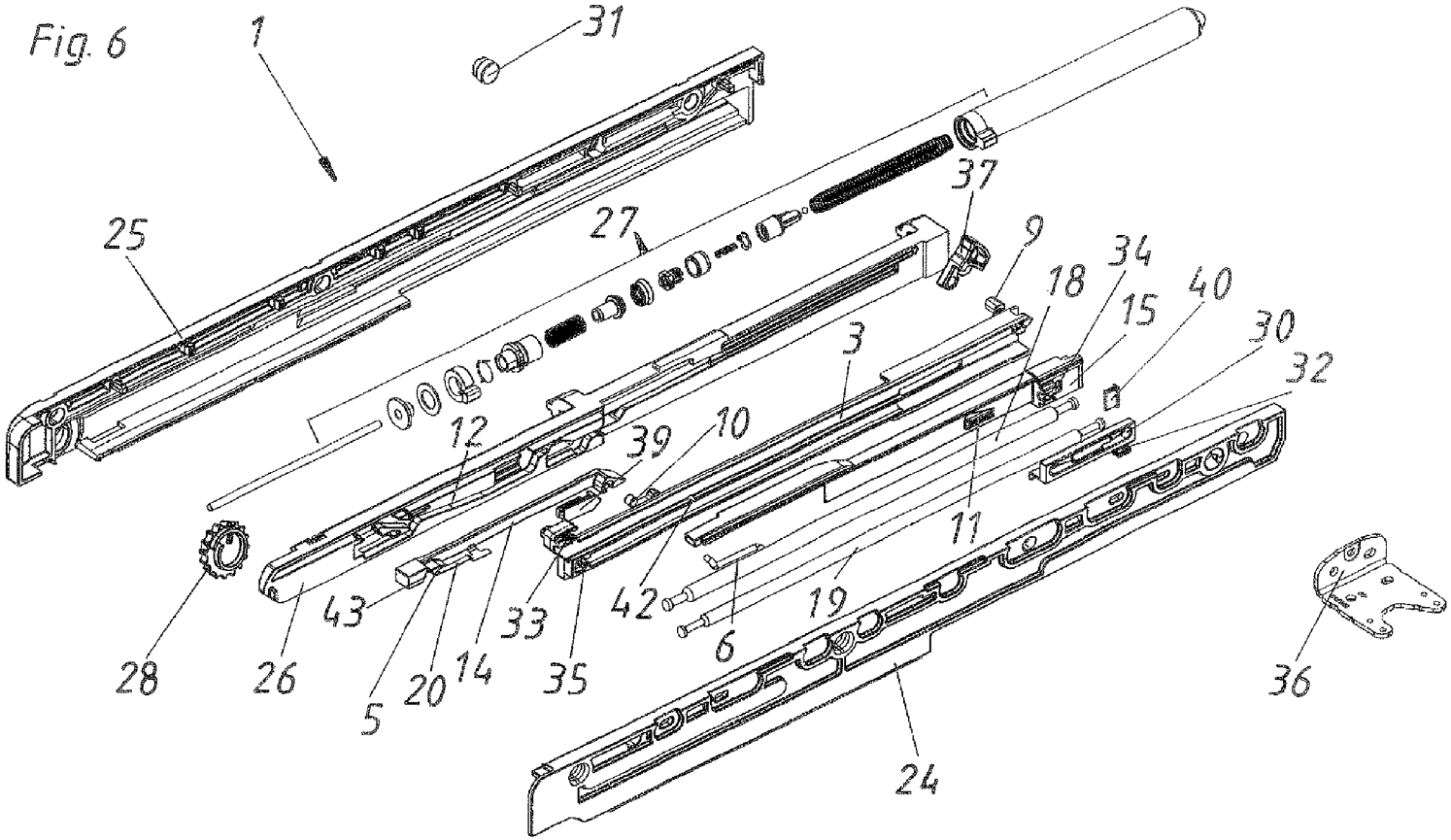

Exploded views of a specific embodiment by way of example of a drive device 1 are shown in FIGS. 5 and 6. In this case the housing base plate 24, the housing center plate 26 and the housing cover 25 together form the housing 1, the housing 4 preferably being mounted to a drawer rail 22 by way of the housing base plate 24. To achieve a change in position of the movable furniture part 2 in its closed position SS relative to the furniture carcass 17 the housing center plate 26 can be displaced relative to the components which are fixed relative to the furniture part, the housing base plate 24 and the housing cover 25. In that case precise setting is possible by way of the adjusting means 28 and the adjusting studs on the housing center plate 26. A damping device 27 for damping the retraction movement of the movable furniture part 2 is also connected to the housing center plate 26. The individual components of that damping device 27 are not identified in greater detail.

Provided in the housing center plate 26 and thus in the housing 4 is the sliding track 12 in which the latching element 6 moves. The latching element is held pivotably at one end at the mounting location 42 in the ejection element 3. The ejection element 3 is movable between abutments relative to the housing center plate 26. Provided on that ejection element 3 is the spring base 33 for the ejection force storage means 18 (tension spring). The other end of the ejection force storage means 18 is held to the spring base 32. That spring base 32 is disposed at the spring stressing element 30 fixedly connected to the housing base plate 24. The spring stressing force can be adjusted depending on the location of fixing of the spring stressing element 30 to the housing base plate 24. The spring stressing element 30 arranged on the housing base plate 24 can be moved relative to the housing base plate 24 by way of the adjusting element 31 and thus the spring stressing force of the ejection force storage means 18 can be set.

Also disposed on the ejection element 3 is a spring base 35 for the retraction force storage means 19 (tension spring) which on the other hand is fixed to the spring base 34 provided on the retraction slide 15. That retraction slide 15 (this can also be referred to as the retraction device 15) is mounted to the ejection slide 3 movably limitedly by abutments. At one end of the retraction slide 15 is disposed the axis of rotation 38 for the catch lever 37. The entrainment member 9 is held by way of that catch lever 37—which is part of the detection device 7—. The entrainment member 9 is fixedly connected to the mounting plate 36 mounted to the carcass rail 23 (not shown). Also provided at the end of the retraction slide 15 is a damping abutment 40 so that upon contact occurring between the retraction slide 15 and the entrainment member 9 no loud noise occurs and the components are handled gently.

The transmission slide 14 mounted movably on the housing center plate 26 is provided for travel-controlled triggering of the ejection slide 3 or for travel-controlled release of the locking action when the pulling force is applied. At one end the slide 14 has the locking element 5 which in part also forms the latching recess 13 of the sliding track 12. Also provided on that transmission slide 14 is the inclined deflection means 43 which also forms the sliding track 12, for the over-pressing action. Held to the front end of the transmission slide 14 is the elastic coupling element 10 which corresponds to the connecting element 11 provided on the retraction slide 15. Also arranged on the transmission slide 14 is the deflection element 20, by way of which the latching element 6 can be moved back into the closed position, in the event of the ejection movement not being complete. The slider 39 resiliently mounted to the housing center plate 26 serves to provide that the latching element 6 does not pass into an unwanted portion of the sliding track 12, in particular when the drawer is pushed shut with too little energy and is ejected again before locking occurs. In such a movement the slider 39 remains closed.

Figure 7:
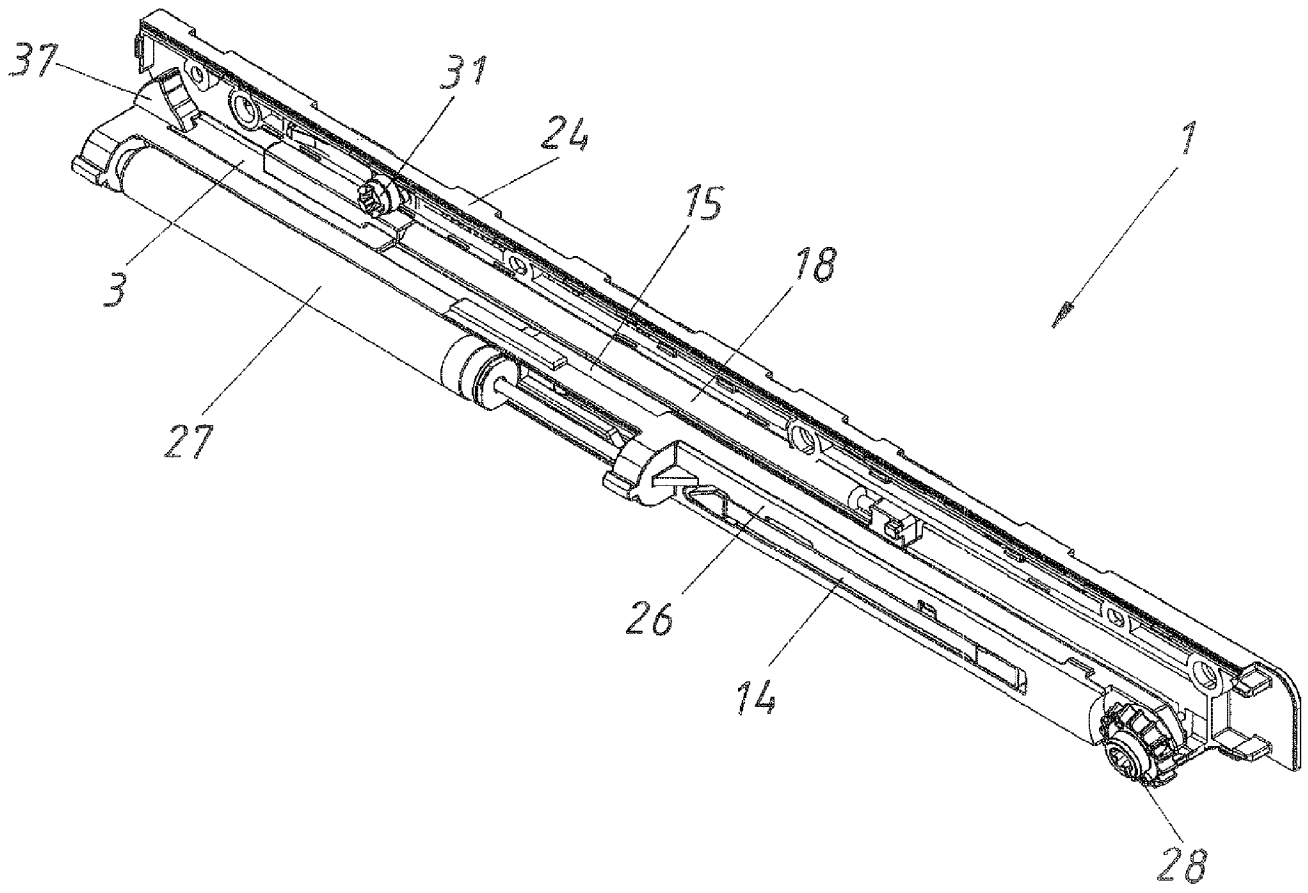
FIGS. 7 through 12 show various broken-away 3D views of the drive device.

FIG. 7 shows the drive device 1 in the assembled condition, with the housing cover 25 removed. It will be seen that the damping device 27 is clamped in the housing center plate 26. The Figure also shows the ejection force storage means 18 which is fixed on the one hand to the housing base plate 24 or the spring stressing element 30 and on the other hand to the ejection slide 3. The retraction slide 15 and the catch lever 37 fixed thereto are also partly visible. The large part of the transmission slide 14 is also visible through the housing center plate 26.

Figure 8:
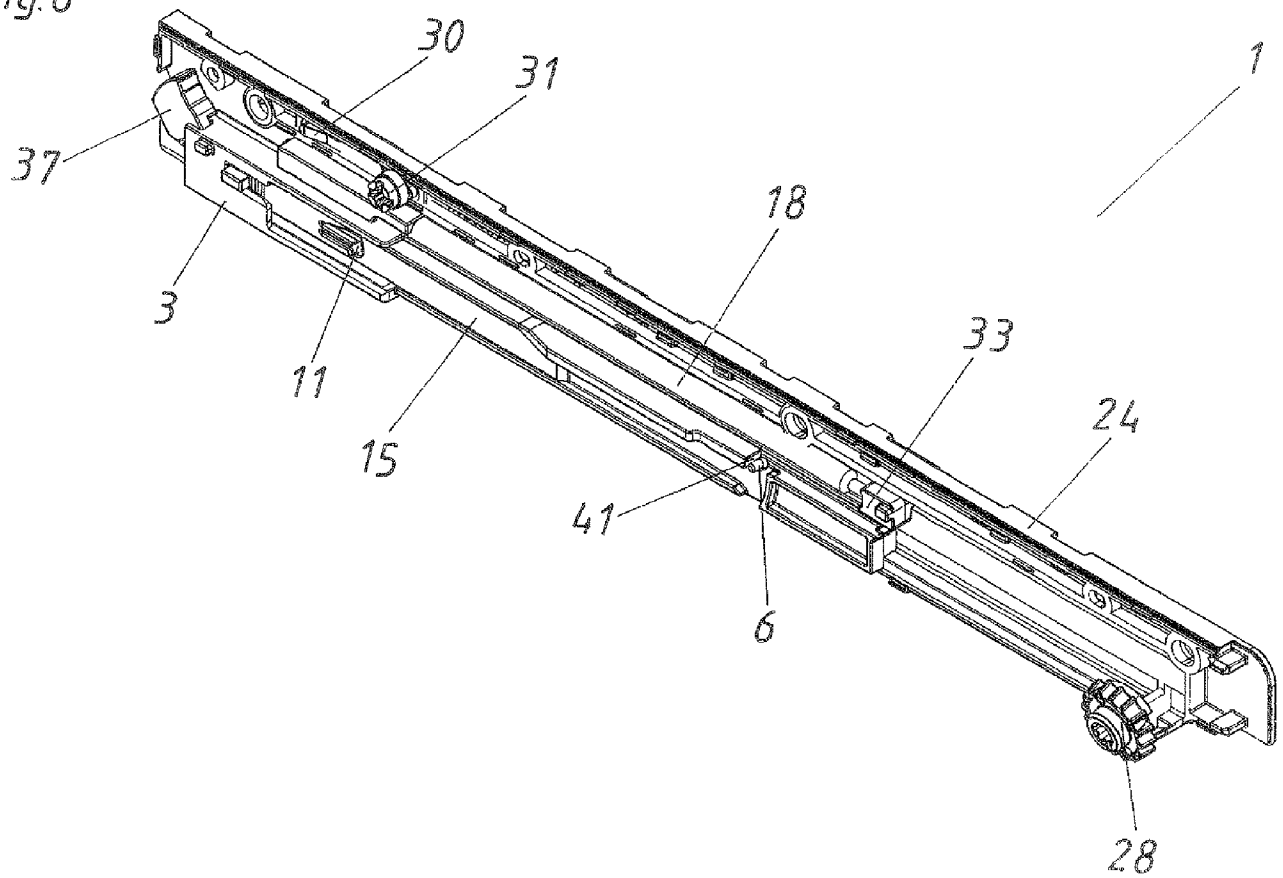

The housing center plate 26 is removed in FIG. 8 in comparison with FIG. 7, thereby guaranteeing a better view of the ejection slide 3 and the retraction slide 15. It will be seen that the latching element 6 bears against an end of the retraction slide 15—which is formed by the latching element abutment 41. The latching element 6 cannot escape from that position as it is guided in the sliding track 12.

Figure 9:
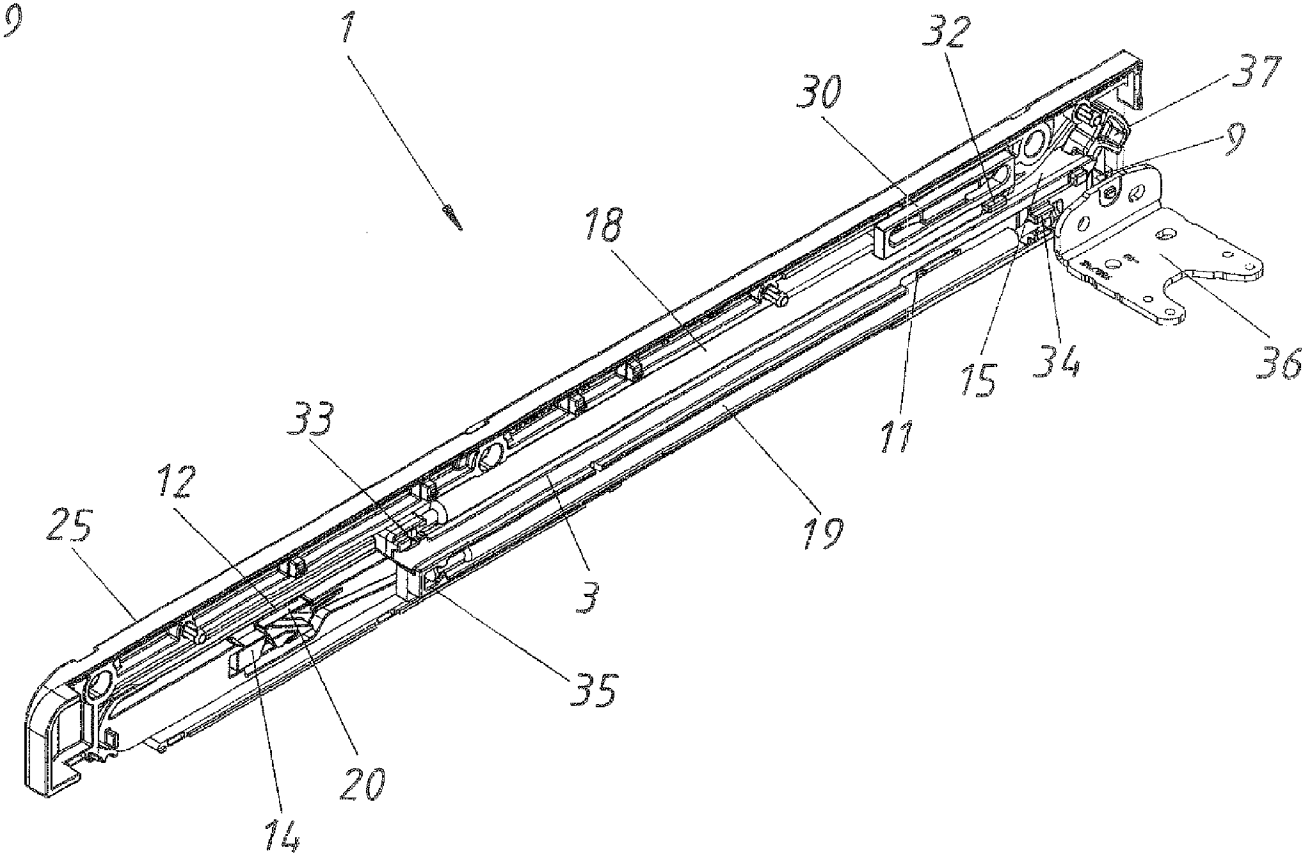

That sliding track 12 is visible for the major part in FIG. 9 in which, of the drive device 1, only the housing base plate 24 is missing. The retraction force storage means 19 which is in the form of a tension spring is in this case held between the spring bases 34 and 35. The ejection force storage means 18 is held to the spring bases 32 and 33. The catch lever 37 is shown in the opened position, wherein the entrainment member 9 already bears against the abutment 40 of the retraction slide 15.

Figure 10:
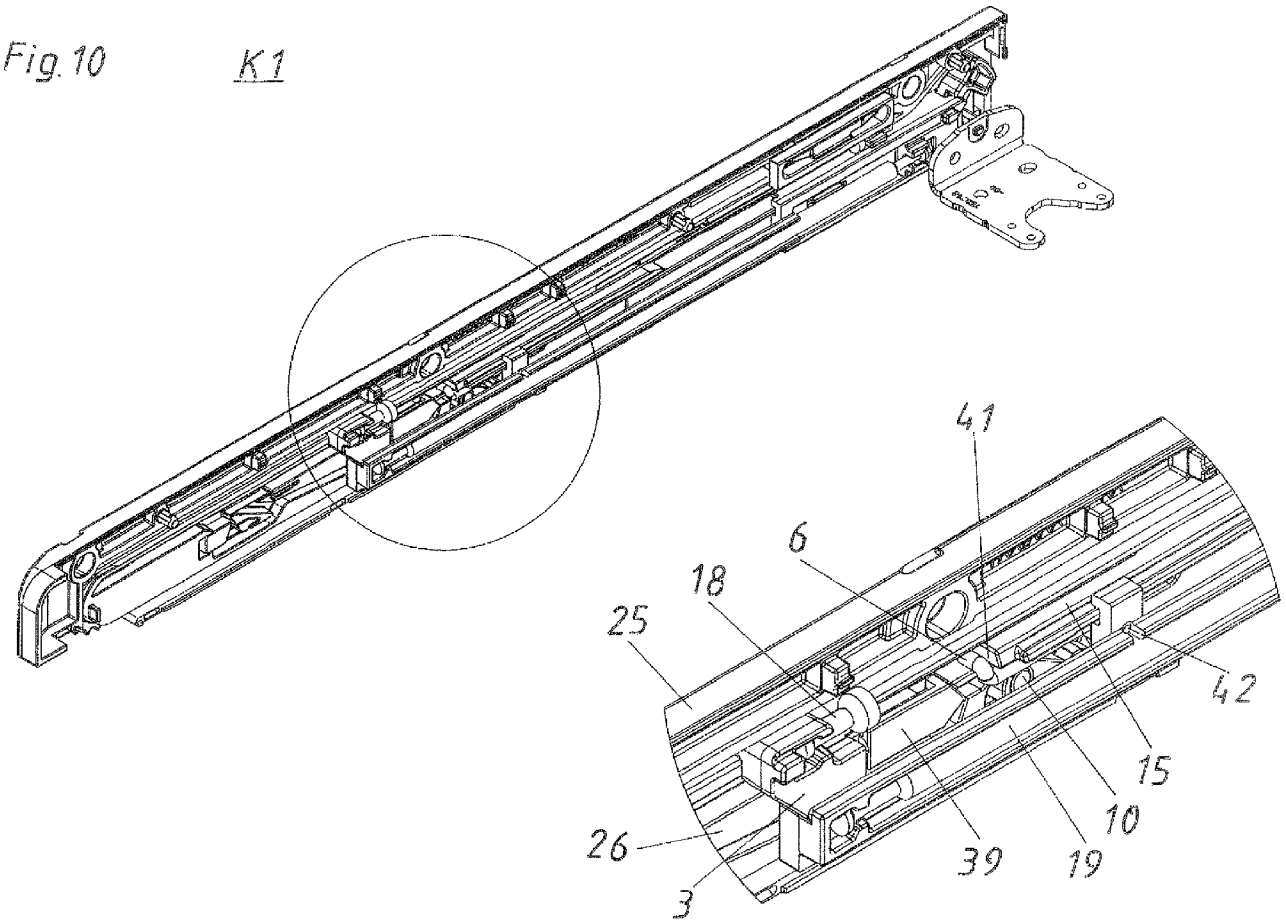

To give a better view in relation to the latching element 6 a part of the ejection slide 3 is removed in FIG. 10, in contrast to FIG. 9. As a result it can be seen that the latching element 6 bears against the sliding track 12 and the latching element abutment 41. In this first coupling position K1 of the latching element 6 the retraction slide 15 is coupled to the ejection slide 3 as the retraction slide 15, by virtue of the latching element abutment 41 bearing against the latching element 6, cannot move further towards the left relative to the ejection slide 3. As a result the retraction force storage means 19 cannot be relieved of stress.

Figure 11:
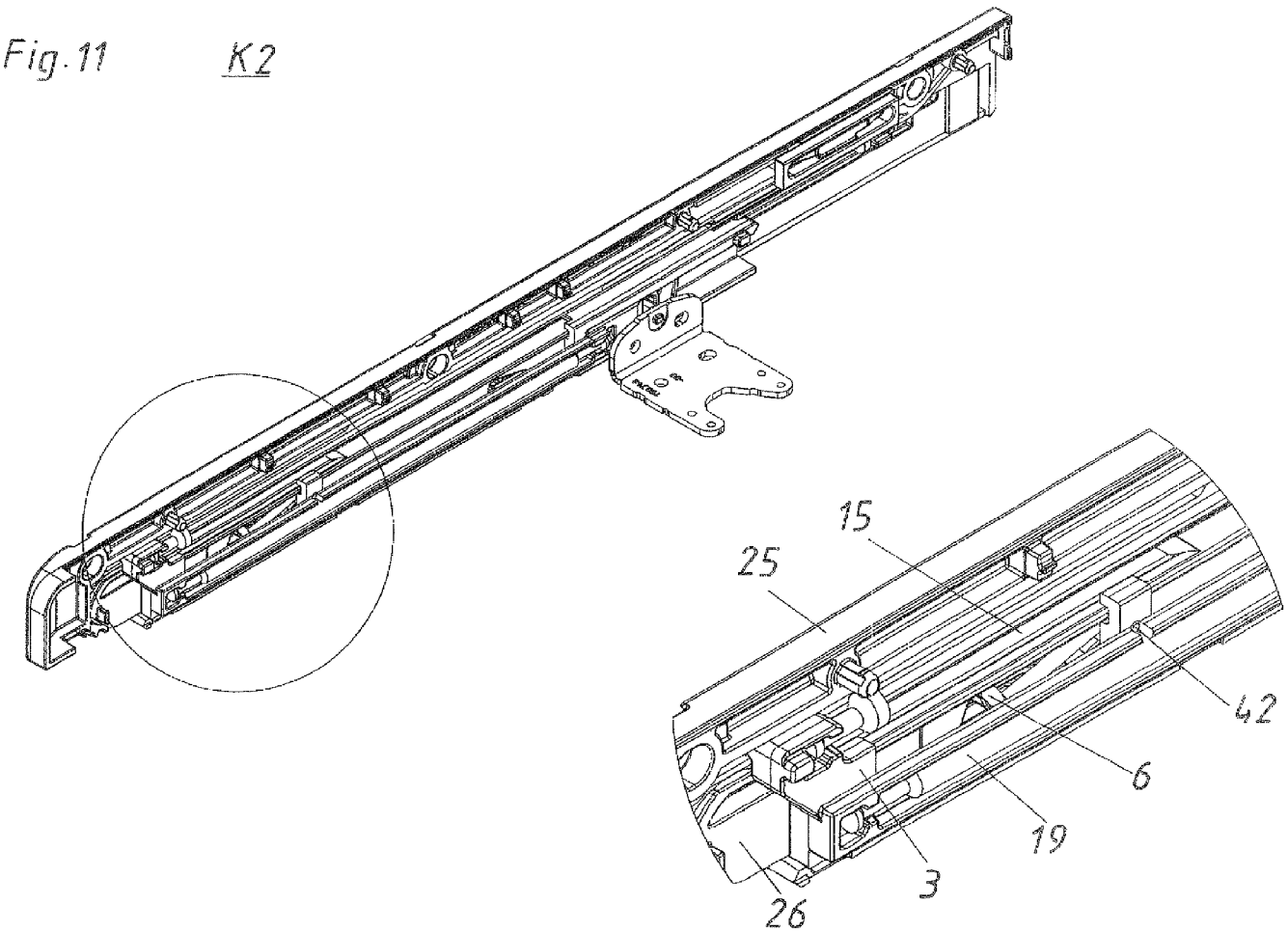

In contrast in FIG. 11 the retraction force storage means 19 is relaxed as the latching element 6 has reached the second coupling position K2 in which the path for the retraction slide 15 relative to the ejection slide 3 has been cleared.

Figure 12:
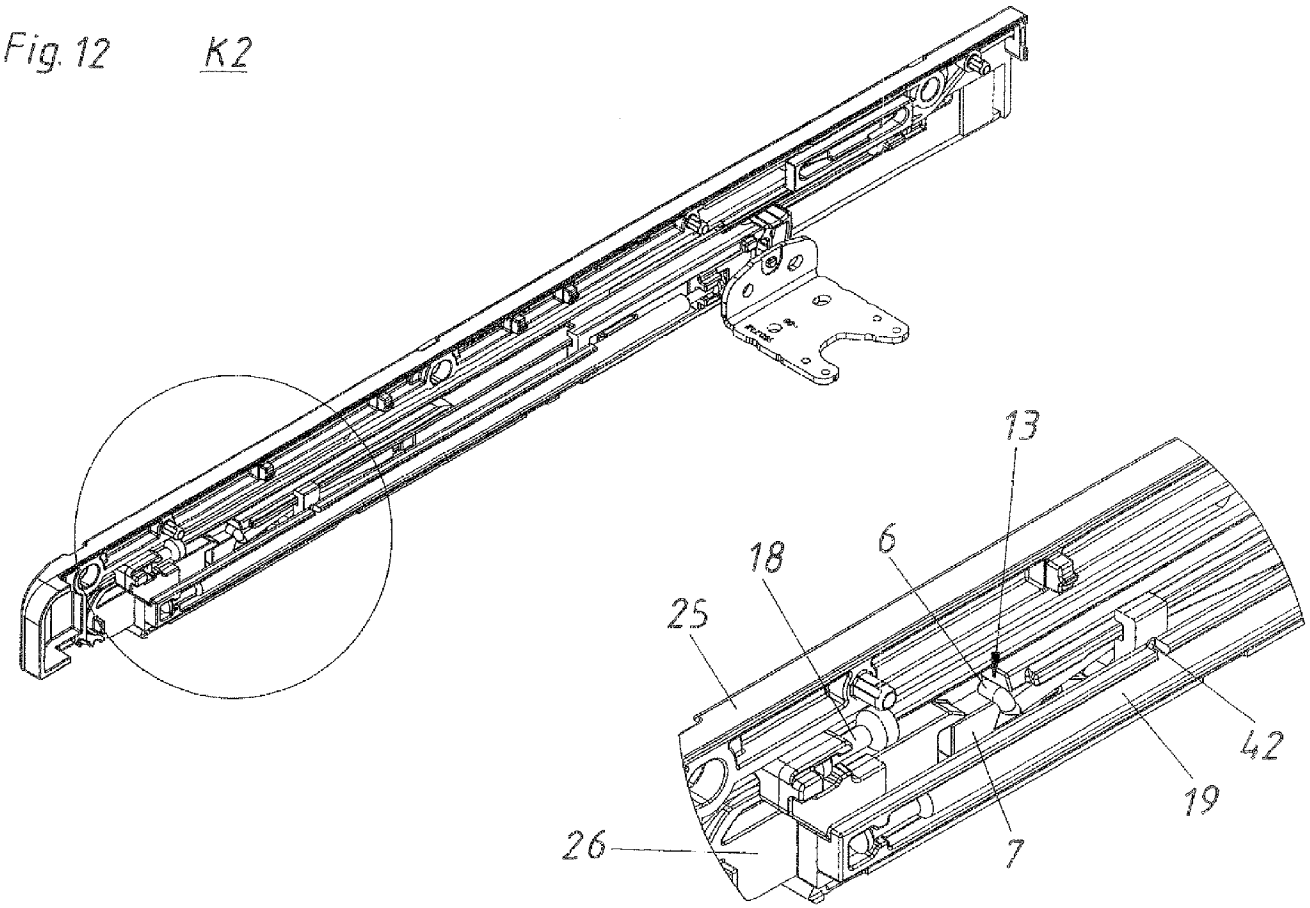

In conformity therewith the retraction slide 15 is partly removed in FIG. 12 so that there is a clear view to the latching element 6 held in or at the latching recess 13.

Figure 13:
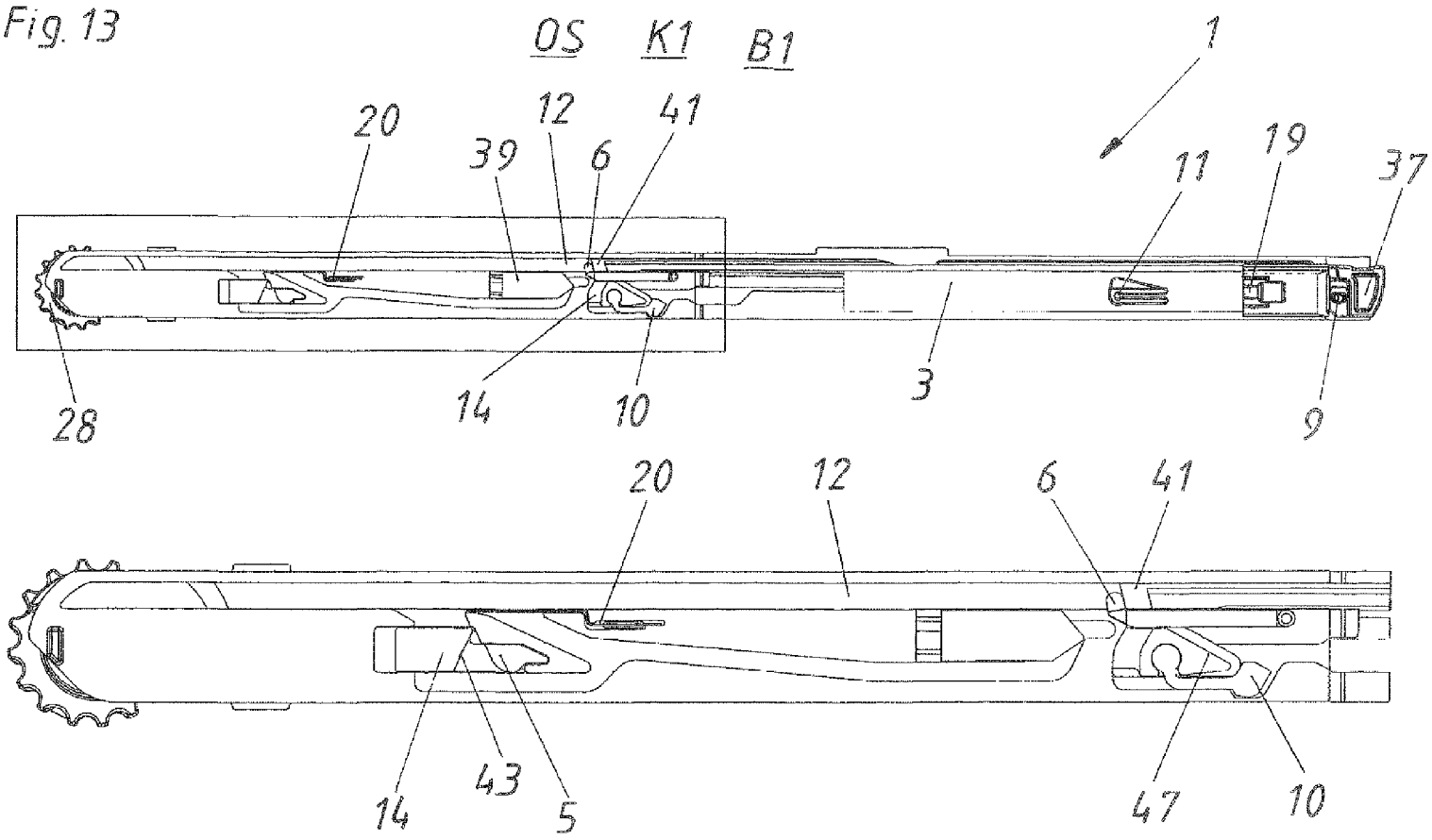
FIGS. 13 through 19 show the movements involved upon closing and unlocking by over-pressing.

In FIG. 13 the drive device 1 and thus the movable furniture part 2 are disposed in the open position OS. Similarly to FIG. 10 the latching element 6 bears against the latching element abutment 41 of the retraction slide 15 and is guided in the sliding track 12 provided in the housing center plate 26. The entire ejection slide 3 is disposed in a first movement portion B1 and the latching element 6 is disposed in the first coupling position K1. The connection to the entrainment member 9 can be seen at the other end of the retraction slide 15, by way of the catch lever 37. Partially concealed by the housing center plate 26 the transmission slide 14 is arranged movably relative to the housing center plate 26. That transmission slide 14 also forms parts of the sliding track 12. Thus the transmission slide for example has the locking element 5 and the inclined deflection means 43 for the latching element 6 and the inclined guide means 47 for the connecting element 11. In addition the coupling element 10 which can correspond to the connecting element 11 is mounted pivotably to the transmission slide 14.

When the movable furniture part 2 is further moved in the closing direction SR in FIG. 13 then the latching element 11 moves along the sliding track 12 which is partly formed by the deflection element 20, while retaining the first coupling position K1. The end of the straight closing portion of the sliding track 12 and thus the end of the first movement portion B1 are reached in FIG. 14.

Figure 14:
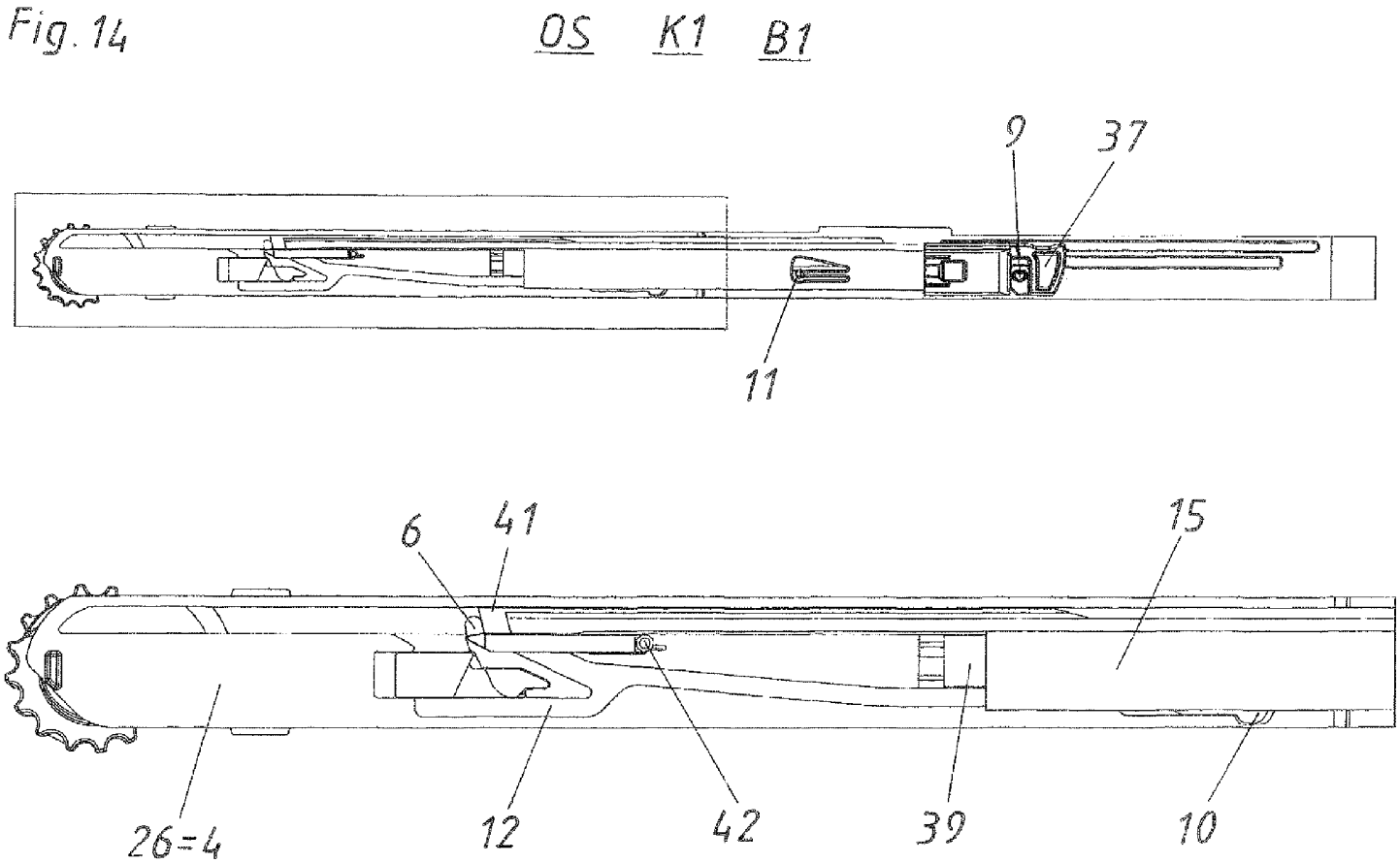
Figure 15:
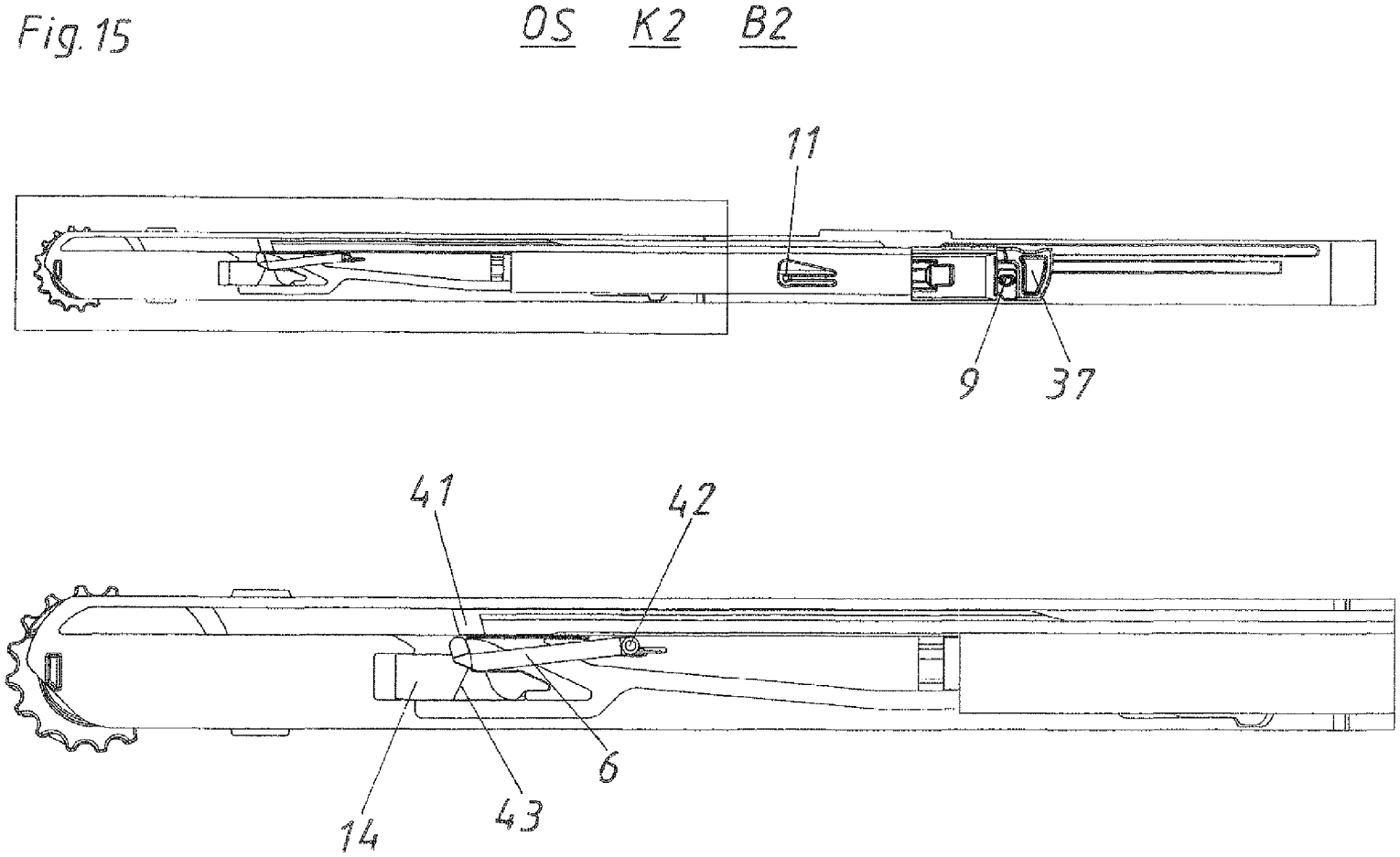

As soon as the movable furniture part 2 is further moved from the position in FIG. 14 into the position shown in FIG. 15 the latching element 6 is urged by the latching element abutment 41 of the retraction slide 15 into the latching recess 13 of the sliding track 12. As a result the retraction slide 15 is uncoupled from the ejection slide 3 and at the same time the ejection slide 3 is locked to the housing 4 and the second coupling position K2 is reached. Thus two coupling operations are implemented by that one movement of the latching element 6.

Figure 16:
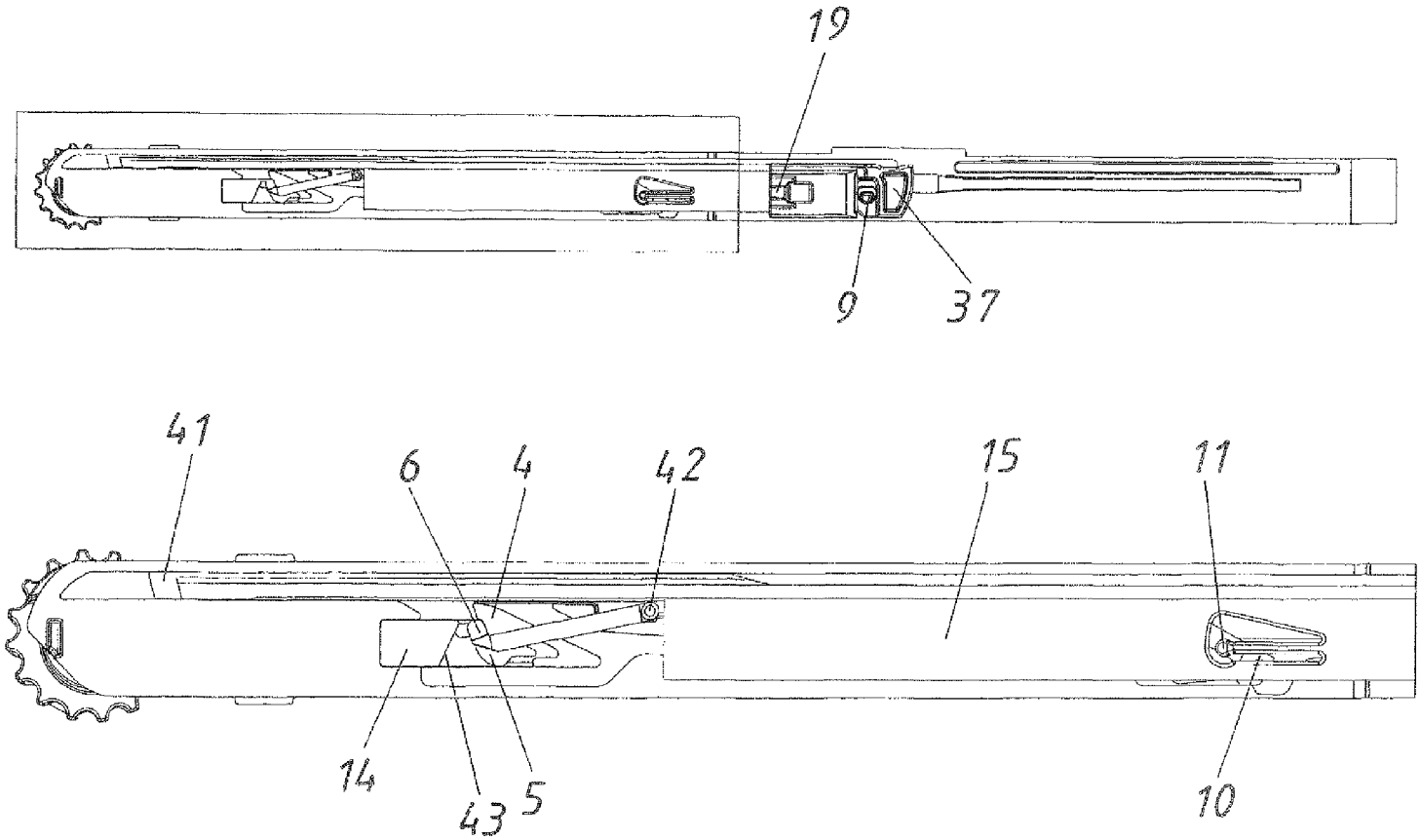

The movable furniture part is moved or retracted from the open position OS in FIG. 15 into the closed position SS in FIG. 16, by stress relief of the retraction force storage means 19. As soon as the connecting element 11 bears against the coupling element 10 of the transmission slide 14 just before the end of that retraction movement the entire transmission slide 14 is firstly moved towards the left to the condition of abutment in the housing center plate 26. After that the connecting element 11 passes over the coupling element 10 in the closing direction SR. With that movement towards the left of the transmission slide 14 its locking element 5 is also moved towards the left and, together with a part of the sliding track 12 provided on the housing 4 (more specifically in the housing center plate 26), forms the actual latching recess 13 for the latching element 6 in the housing 4. The latching element thus remains in the second coupling position K2, even if slightly displaced in relation to FIG. 15. It can be clearly seen from FIG. 16 that the sliding track 12 now involves a cardioid shape.

Figure 17:
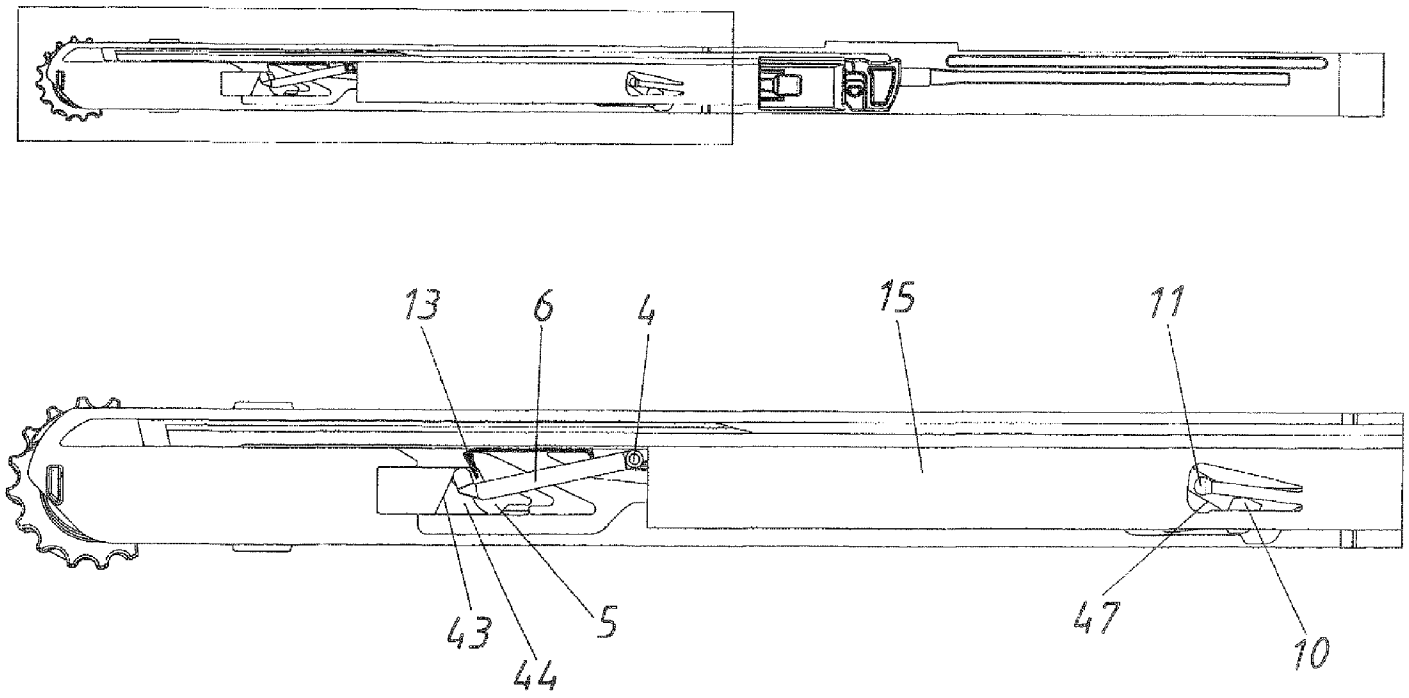
Figure 18:
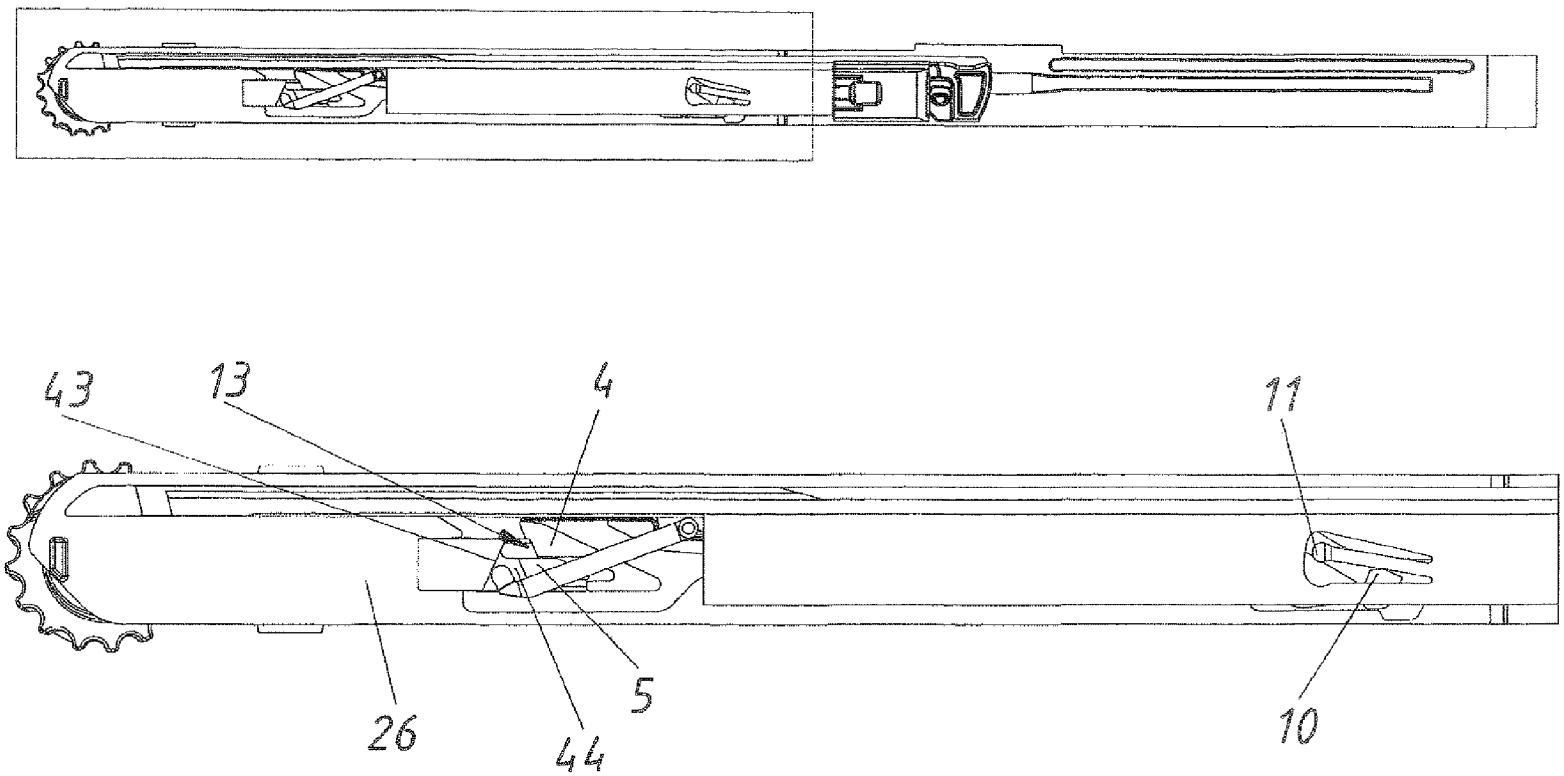

If pressure is applied to the movable furniture part 2 in the closing direction SR in that closed position SS (see FIG. 17) the retraction slide 15 is also further moved in the closing direction SR. As that retraction slide 15 has reached an end abutment at the ejection slide 3 in that closed position SS the ejection slide 3 is also moved in the closing direction SR together with the latching element 6 mounted pivotably thereto. As a result the latching element 6 moves as shown in FIG. 17 out of the latching recess 13 until the latching element bears against the inclined deflection means 43. The over-pressed position US is reached thereby. At the same time the connecting element 11 is also deflected by the inclined guide means 47.

Due to deflection at the inclined deflection means 43 (see FIG. 18) the latching element 6 passes further through the depression 44 provided in the depression slide 14 and forming a part of the sliding track 12, in the direction of the opening portion 45 of the sliding track 12.

Figure 19:
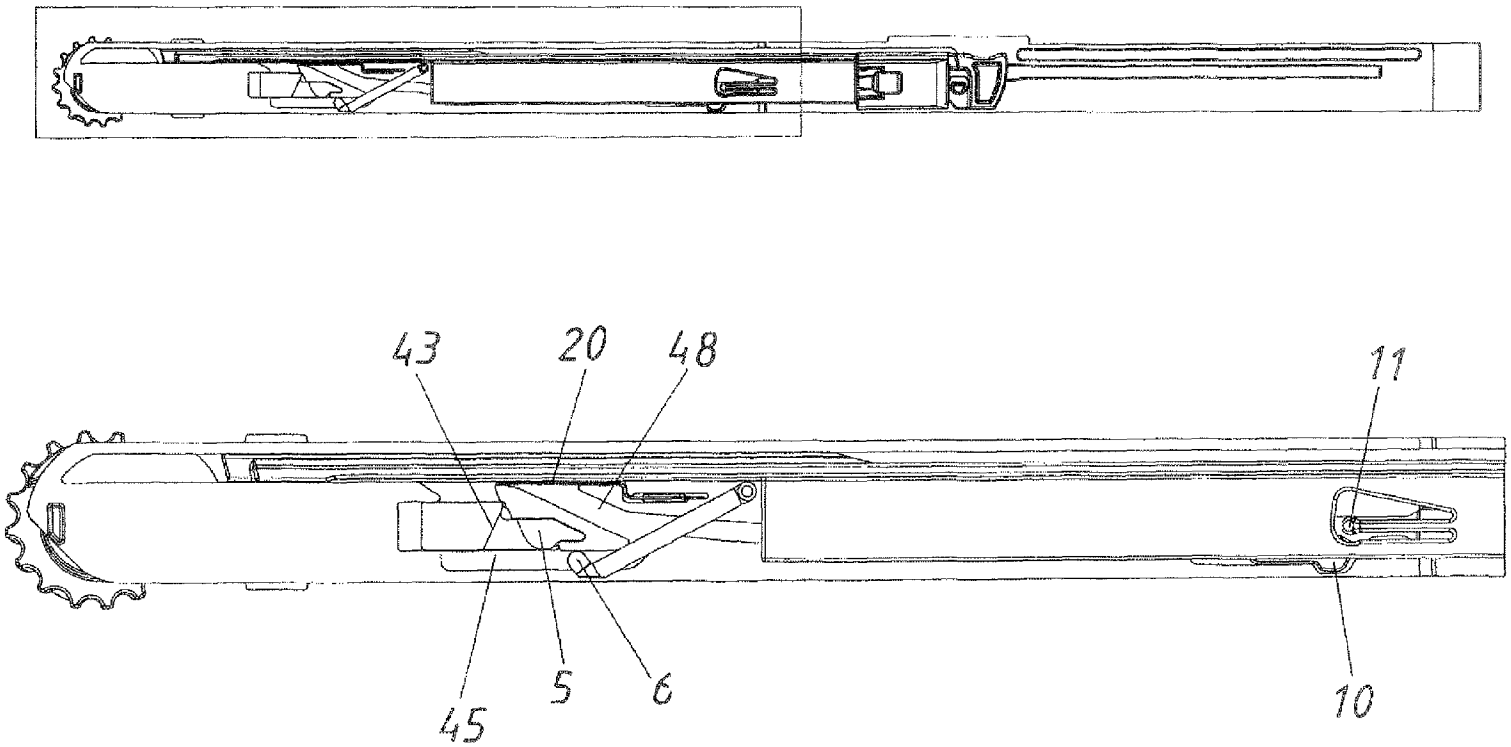
Figure 20:
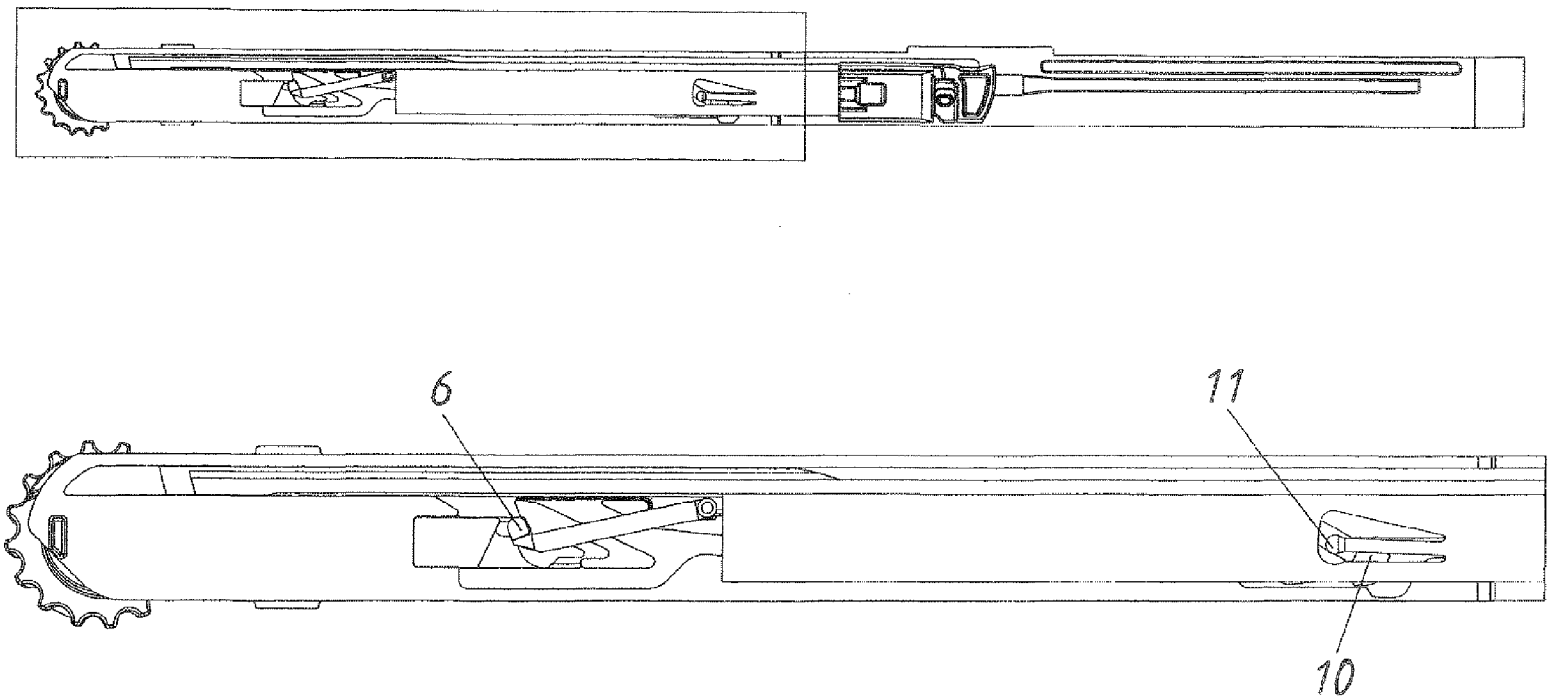
FIGS. 20 through 22 show the movements involved in unlocking by pulling.

As soon as that opening portion 45 is reached the ejection element 3 is unlocked and the ejection force storage means 18 can be relieved of stress and the movable furniture part 2 is ejected in the opening direction OR and passes into the open position OS (see FIG. 19). In that ejection movement the transmission slide 14 is moved again by the connecting element 11 by way of the coupling element 10 until reaching a condition of abutment a distance in the opening direction OR so that the initial position of the transmission slide 14 is restored. If the opening movement should already be interrupted shortly after the start, then upon re-closing, the latching element 6 can move through the deflection passage 48 and the latching element 6 passes into the closing portion of the sliding track 12 again, due to the deflection element 20 which is of a flap configuration being urged away.

FIG. 20 again shows the closed position SS in which the latching element 6 is in the second coupling position K2. That FIG. 20 corresponds to the view in FIG. 16.

Figure 21:
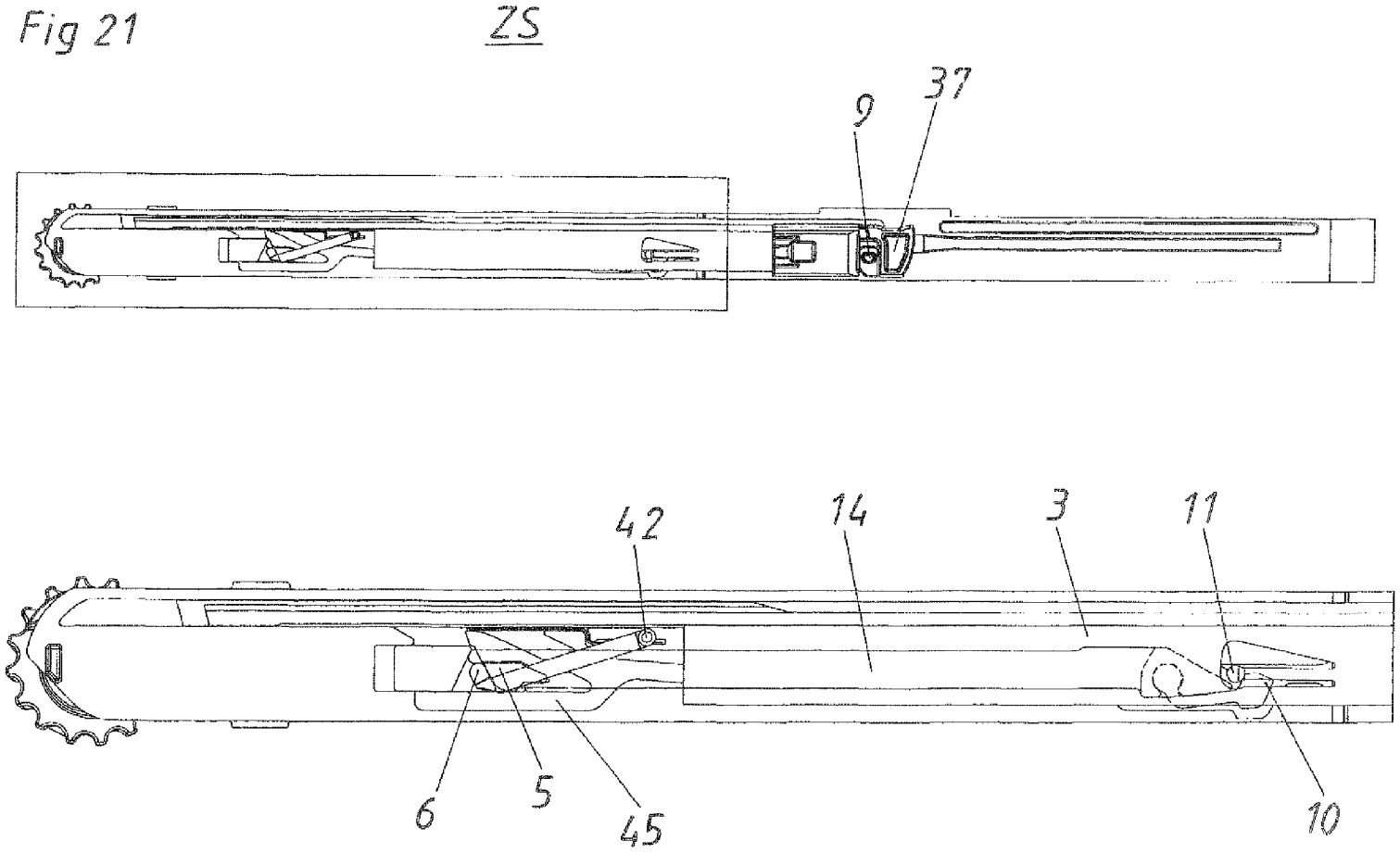

If now pressure is not applied to the movable furniture part 2 from that closed position SS, but a pulling force is applied to the movable furniture part 2, that movement is detected by the detection device 7 formed by the catch lever 37 and the retraction slide 15. As a result the retraction slide 15 and therewith the connecting element 11 are moved towards the right until it bears against the coupling element 10 and entrains it. Due to the coupling element 10 being entrained in that way, as shown in FIG. 21, the entire transmission slide 14 is also moved and the locking element 5 no longer forms a part of the latching recess 13. In that way the path for the latching element 6 is no longer blocked by the locking element 5 and the path into the opening portion 45 of the sliding track 12 is clear. Accordingly transmission of the pulling movement is not effected directly to the latching element 6, but so-to-speak the latching abutment (=locking element 5) is drawn away from that latching element 6 and thus the locking position or the second coupling position K2 is nullified.

Figure 22:
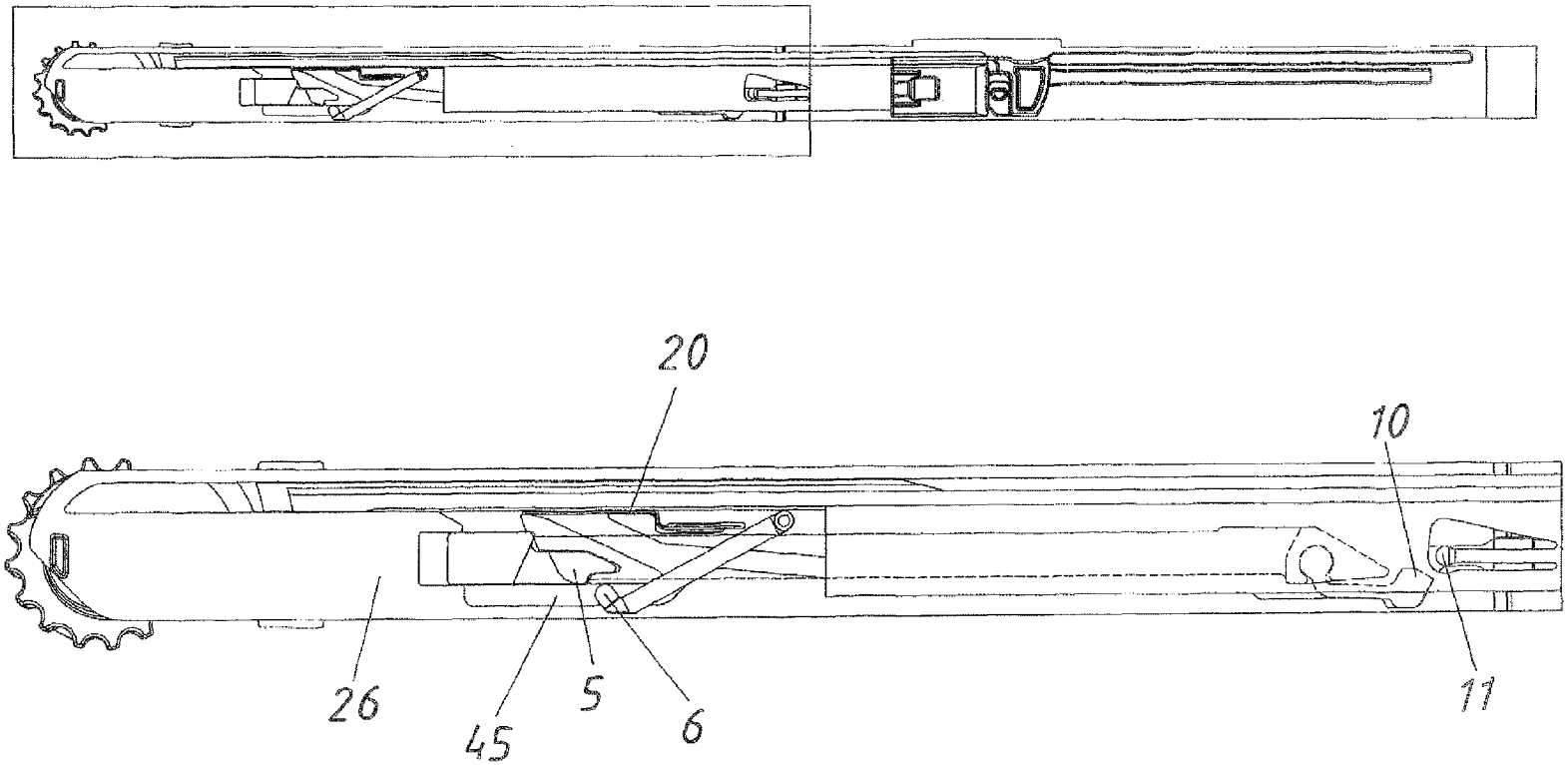

As a further consequence, as shown in FIG. 22, the ejection force storage means 18 can be relieved of stress again and, by way of the ejection slide 3 and the retraction slide 15 held thereto, moves the movable furniture part 2 in the opening direction OR. As soon as the ejection force storage means 18 has completely relaxed the retraction force storage means 19 is loaded with the further momentum of the movable furniture part 2 or by actively pulling on the movable furniture part 2 in the opening direction OR, until the first coupling position K1 between the retraction slide 15 and the ejection slide 3 is regained. Upon closure of the movable furniture part 2 then as a further consequence the ejection force storage mans 18 is relaxed before the locking position or the second coupling position K2 is reached. That substantially corresponds to the first movement portion B1 which is between the positions shown in FIG. 13 and FIG. 14.

Because the retraction slide 15 can be coupled to the ejection slide 3 by way of the latching element 6 this therefore implements a simplified drive device 1 for a movable furniture part 2, which is quieter than in the state of the art.

The invention claimed is:

1. A drive device for a movable furniture part, comprising:
a housing;
an ejection slide mounted movably in or on the housing for ejection of the movable furniture part from a closed position in the opening direction;
a retraction slide movable relative to the housing for retraction of the movable furniture part from an open position into the closed position; and
a latching element which is mounted movably on the ejection slide and by way of which the ejection slide is locked to the housing at least in the closed position,
wherein the retraction slide can be coupled to the ejection slide by way of the latching element.

2. A drive device as set forth in claim 1, wherein the retraction slide is mounted movably to the ejection slide.

3. A drive device as set forth in claim 1, wherein the retraction slide can be coupled to the movable furniture part by way of an entrainment member.

4. A drive device as set forth in claim 1, wherein the ejection slide is acted upon by a force in the opening direction by an ejection force storage means, one end of the ejection force storage means being fixed to the housing, and another end of the ejection force storage means being fixed to the ejection slide.

5. A drive device as set forth in claim 1, wherein the refraction slide is acted upon by a force in the closing direction by a retraction force storage means, one end of the retraction force storage means being fixed to the ejection slide, and another end of the retraction force storage means being fixed to the retraction slide.

6. An article of furniture comprising:
a furniture carcass;
a movable furniture part; and
a drive device as set forth in claim 1 for the movable furniture part.

7. A drive device as set forth in claim 1, wherein the refraction slide can be coupled to the ejection slide by way of the latching element in a first coupling position,
and wherein in the first coupling position, the latching element directly engages the ejection slide.

8. A drive device as set forth in claim 1, wherein the ejection slide is locked in a second coupling position via the latching element to the housing,
and wherein in the second coupling position, the latching element directly engages a latching recess of the housing.

* * * * *